US005331693A

United States Patent [19]

Petersen et al.

[11] Patent Number: 5,331,693

[45] Date of Patent: Jul. 26, 1994

[54] LADY'S FOOTREST FOR USE IN THE BATH

[76] Inventors: Kimberlee C. Petersen, 2403 SW. 41st St., Lawton, Okla. 73505; Mary L. Hall, 13101 W. 76th St., Lenexa, Kans. 66216

[21] Appl. No.: 949,045

[22] Filed: Sep. 21, 1992

[51] Int. Cl.[5] ..... A47K 3/12

[52] U.S. Cl. ..... 4/574.1; 248/206.3

[58] Field of Search ..... 4/605, 611, 614, 571.1, 4/574.1, 589; 248/118, 205.3-206.4; 312/246

[56] References Cited

U.S. PATENT DOCUMENTS

| | | | |
|---|---|---|---|
| D. 170,853 | 11/1953 | Dunham . | |
| 2,182,532 | 12/1939 | Bentz | 4/574.1 |
| 2,557,434 | 6/1951 | Hoverder | 248/205.6 |
| 2,809,877 | 10/1957 | Hammesfahr | 312/246 |
| 2,825,069 | 3/1958 | Jorgensen et al. | 248/205.5 |
| 3,185,537 | 5/1965 | Wright | 248/206.1 X |
| 3,193,848 | 7/1965 | Levy | 4/611 |
| 3,396,413 | 8/1968 | Kaufman | 4/574.1 |
| 3,713,180 | 1/1973 | Martin | 4/185 |
| 4,489,448 | 12/1984 | Cairo | 4/574 |
| 4,944,478 | 7/1990 | Sullivan | 248/205.7 |

FOREIGN PATENT DOCUMENTS

| | | | |
|---|---|---|---|
| 2405599 | 8/1975 | Fed. Rep. of Germany | 4/611 |
| 0810914 | 3/1959 | United Kingdom | 4/577.1 |

*Primary Examiner*—Charles E. Phillips
*Attorney, Agent, or Firm*—Kenneth W. Iles

[57] ABSTRACT

A lady's footrest for use in the shower or bath provides a portable footrest having an elongated body with a uniform cross section having a roughly triangular upper non-skid surface for resting the foot on and a plurality of suction cups fixed to the rear wall of the apparatus for temporarily securing the apparatus to a side wall of a shower or bathtub. The apparatus further includes a drawer for holding toilet and shaving items and at least one drain hole for allowing any accumulated water to drain from the apparatus. At least one drain hole is also located in the body of the footrest.

4 Claims, 2 Drawing Sheets

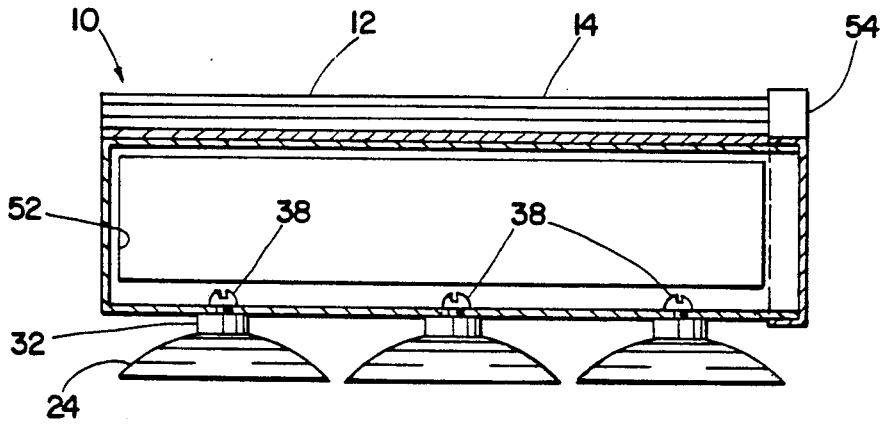
Fig. 4
Fig. 5
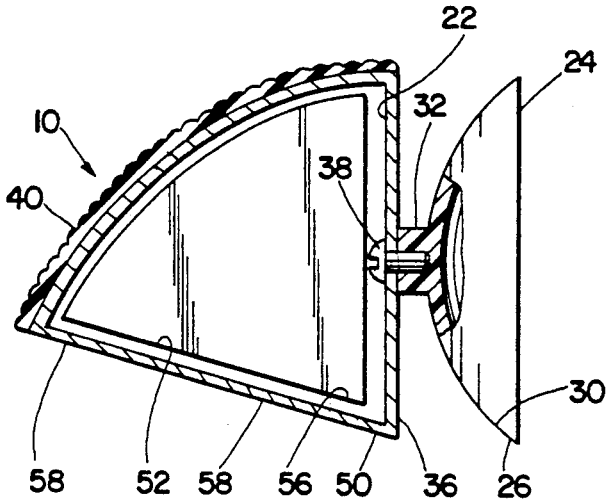
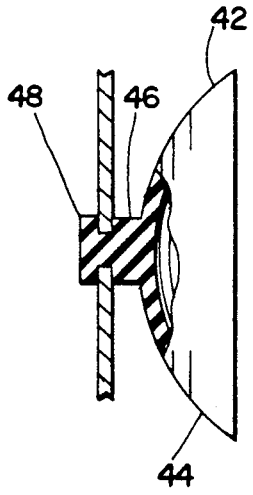
Fig. 6
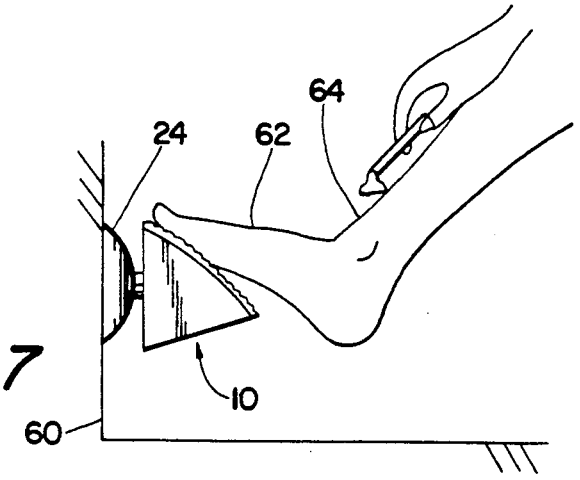
Fig. 7

LADY'S FOOTREST FOR USE IN THE BATH

BACKGROUND OF THE INVENTION

1. Field of the Invention

The present invention is related to an apparatus for assisting woman who shave their legs in the shower or bath. More particularly, the present invention comprises a portable footrest for use in the bath, which can be temporarily attached to the wall of the shower or bath.

2. Description of Related Art Including Information Disclosed Under 37 C.F.R. Sections 1.97–1.99

Most women in the United States shave their legs as the preferred means for removing hair from them. Most of these women shave their legs while bathing or showering. This task is normally tedious and awkward, as it requires bending sharply at the waist and limits visibility because it is not easy to get close enough to the legs to see them well or to manipulate the razor with great dexterity. This increases the likelihood of cutting or nicking the legs with a razor and is therefore frequently regarded as an unpleasant chore.

Further, many elderly and handicapped women find that shaving their legs is not only an unpleasant chore, but it can be dangerous. This is especially the case with women who nave an impaired sense of balance.

A related problem is that women want their shaving utensils readily at hand but typically would rather not simply leave them on the side of the bathtub in plain sight. Showers typically have no place to store shaving and other hygiene appliances. Sometimes these items are stored in plastic net bags or shelves that hang from the neck of the shower pipe. These solutions, however, are not entirely satisfactory because they slip down the neck of the shower pipe or swing from side to side as contents are removed or added, disturbing the balance of the device and frequently spilling its contents onto the floor.

The use of a surface above the floor of the shower or tub to rest the foot on, thereby bending the leg at the knee and raising the foot and leg facilitates shaving the legs. Many women use the side of a bathtub for this purpose, but the rim or top surface of a bathtub is narrow, and very slippery, making this practice somewhat hazards and therefore requiring concentration on safety and less on the task of shaving. Naturally, most showers have no similar elevated surface to rest the foot on, particularly in institutional settings, such as dormitories. A search of the related art at the Public Search Room of the United States Patent and Trademark Office did not reveal any devices directed to this particularly feminine problem.

Of course, there are other occasions when either men or women wish to elevate one foot for one reason or another and this need has lead to a number of issued United States Patents, some of which are discussed below.

U.S. Pat. No. 4,944,478, issued to Sullivan on Jul. 31, 1990 (Sullivan '478) discloses a "Portable Grab Bar" for use in a shower and the like that is attached to a flat smooth surface by suction cups. The suction cups include vacuum pumps that can be used to restore the vacuum in the suction cups if they begin to leak during use.

U.S. Pat. No. 4,489,448, issued to Cairo on Dec. 25, 1984 Cairo '448), discloses a "Foot Support For Showers" comprising a four-legged stool having a top sculpted into the shape of the bottom of a foot. The stool sits on the floor of the shower and is supported by its legs. The bottom end of each leg includes a suction cup or other non-slip foot.

U.S. Pat. No. 3,713,180, issued to Martin on Jan. 30, 1973 (Martin '180), discloses a "Foot Support for Shower Baths" comprising a footrest member covered with a resilient arched upper surface. The footrest is attached to an arm or bracket that is fixed to the shower wall by screws or the like. The arm holds the footrest away from the wall. The arm or bracket conveniently folds to move the footrest out of the way when not in use.

U.S. Pat. No. 2,825,069, issued to Jorgensen et al. on Mar. 4, 1958 (Jorgensen et al. '069), discloses a "Headrest for Use in a Bathtub" comprising a suction cup for attaching the headrest to a wall of a bathtub. This suction cup is attached by a ball and socket joint to a pair of arms leading to two suction cups similar to the attachment suction cup and also attached to the arms by ball and socket joints. These two suction cups cradle the user's head.

Design U.S. Pat. No. 170,853, issued to Dunham on Nov. 17, 1953 (Dunham Des. '853), discloses a "Shower Footrest" comprising a three-legged stool with a horizontally disposed cylindrical footrest attached to the tops of the legs. The stool rests on the floor of the shower and is supported by its legs.

U.S. Pat. No. 2,557,434, issued to Hoverder on Jun. 19, 1951 (Hoverder '434), discloses a "Supporting Fixture" comprising a unitary shelf and support bracket that is attached to a wall by a pair of suction cups. The holding power of the suction cups is augmented by different types of adhesives that glue the suction cups to the wall in various types of usage. Thus, Hoverder actually discloses a permanently installed shelf.

Use of suction cups for temporary or permanent support of a shelf (Hoverder '434), grab bar (Sullivan '478), stool (Cairo '448) are shown in the references discussed above. Also shown specifically is the use of suction cups to secure a bar in a shower (Sullivan '478) or bathtub (Jorgensen et al. '069). A shower foot support or stool is also disclosed in the references discussed above (Dunham Des. '853; Cairo '448). A footrest attached to the wall of a shower by permanent mechanical fasteners is disclosed in Martin '180. Also disclosed is the use of a ribbed non-slip surface on the footrest (Dunham Des. '853).

None of these references, however, discloses a footrest that can be attached to the shower wall temporarily and then removed from the tub or shower entirely for storage. Also not shown is the use of suction cups to attach the temporary use footrest to the shower, the specific structure of the suction cups which allows them to be easily attached to the footrest itself.

Accordingly there is a need for a lady's portable footrest for use in the shower that is readily installed for temporary use and then easily removed for easy storage; that will not mare shower walls or bathtubs; that provides a secure surface for resting the foot on; that provides an arcuate upper surface that approximately matches the natural curve of the arch of the foot for comfort and safety; that includes a non-skid surface for safety and comfort; that can be easily installed at any convenient height for a particular user; that is lightweight and durable; that will not accumulate water; that is relatively simple and inexpensive to manufacture; and that provides a means for conveniently storing small shaving items and the like.

The present invention eliminates these problems and provides the additional benefit of not restricting the space available in the shower or bath when the woman is not shaving.

SUMMARY OF THE INVENTION

Accordingly, it is a primary object of the present invention to provide a lady's portable footrest for use in the shower or bath that facilitates and eases shaving a woman's legs.

It is a further object of the present invention to provide a lady's footrest for use in the shower or bath that is readily installed for temporary use and the easily removed for storage.

It is a further object of the present invention to provide a lady's footrest for use in the shower or bath that will not mare shower wall or bathtubs.

It is a further object of the present invention to provide a lady's footrest for use in the shower or bath that provides a secure surface for resting the foot on.

It is a further object of the present invention to provide a lady's footrest for use in the shower or bath that provides an arcuate upper surface that approximately matches the natural curve of the arch of the foot for comfort and safety.

It is a further object of the present invention to provide a lady's footrest for use in the shower or bath that can be readily installed at any convenient height for a particular user.

It is a further object of the present invention to provide a lady's footrest for use in the shower or bath that has a non-skid surface for safety and comfort.

It is a further object of the present invention to provide a lady's footrest for use in the shower or bath that is light-weight and durable.

It is a further object of the present invention to provide a lady's footrest for use in the shower or bath that will not accumulate water.

It is a further object of the present invention to provide a lady's footrest for use in the shower or bath that is relatively simple and inexpensive to manufacture.

It is a further object of the present invention to provide a lady's footrest for use in the shower or bath that provides a means for conveniently storing small shaving items and the like.

Structurally, the invention comprises an elongated hollow body having a substantially triangular end elevation presenting a curved convex non-skid high friction upper surface. A front elevation presents a substantially rectangular form. The rear side of the device includes a plurality of apertures into which efficient suction cups are inserted. Three suction cups are shown in the preferred embodiment disclosed herein. The suction cups include a knob on the non-suction end of the stem into which a screw, such as a self-tapping sheet metal screw, is inserted, thereby securing the suction cup into the rear wall of the footrest. In an alternative embodiment, the suction cups include a knob on the non-suction end of the stem that includes a circular flange having a relaxed diameter greater than the diameter of the apertures they are inserted into. The flanges are forced into the apertures and expand once the back wall of the footrest is penetrated, thus locking the suction cups into place.

The footrest further comprises a small drawer that extends from one end and is stored inside the body of the footrest when the drawer is closed. Toilet items such as razors, shaving aids, and the like can be conveniently stored inside the drawer. Also included in the footrest is at least one drain hole that allows any water that may enter the hollow body to drain back into the tub or shower, thereby preventing water from stagnating inside the footrest.

The footrest may be conveniently made from molded plastic and the like. Alternatively, it may be made of a more expensive, durable and ornamental material, such as brushed stainless steel, brass and the like. In this case, the bottom wall of the embodiment illustrated in the drawings may be omitted if desired, as it is not necessary for strength and rigidity.

Other objects and advantages of the present invention will become apparent from the following description taken in connection with the accompanying drawings, wherein is set forth by way of illustration and example, the preferred embodiment of the present invention and the best mode currently known to the inventors for carrying out their invention.

BRIEF DESCRIPTION OF THE DRAWING

FIG. 4 is a cross section of the footrest taken along lines 4—4 of FIG. 2.

FIG. 5 is a cross section footrest of FIG. 1 taken along line 5—5 of FIG. 2, highlighting the means for attaching the suction cups to the footrest.

FIG. 6 is an enlarged fragmentary view of an alternative embodiment of a suction cup having a different means for attaching the suction cup to the footrest.

FIG. 7 is an environmental view shown in left side elevation illustrating the footrest of FIG. 1 in use.

DETAILED DESCRIPTION OF THE PREFERRED EMBODIMENTS

As required by the Patent Statutes and the case law, the preferred embodiment of the present invention and the best mode currently known to the inventors for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus and process disclosed herein as embodied in any appropriately specific and detailed structure.

Figure 1:
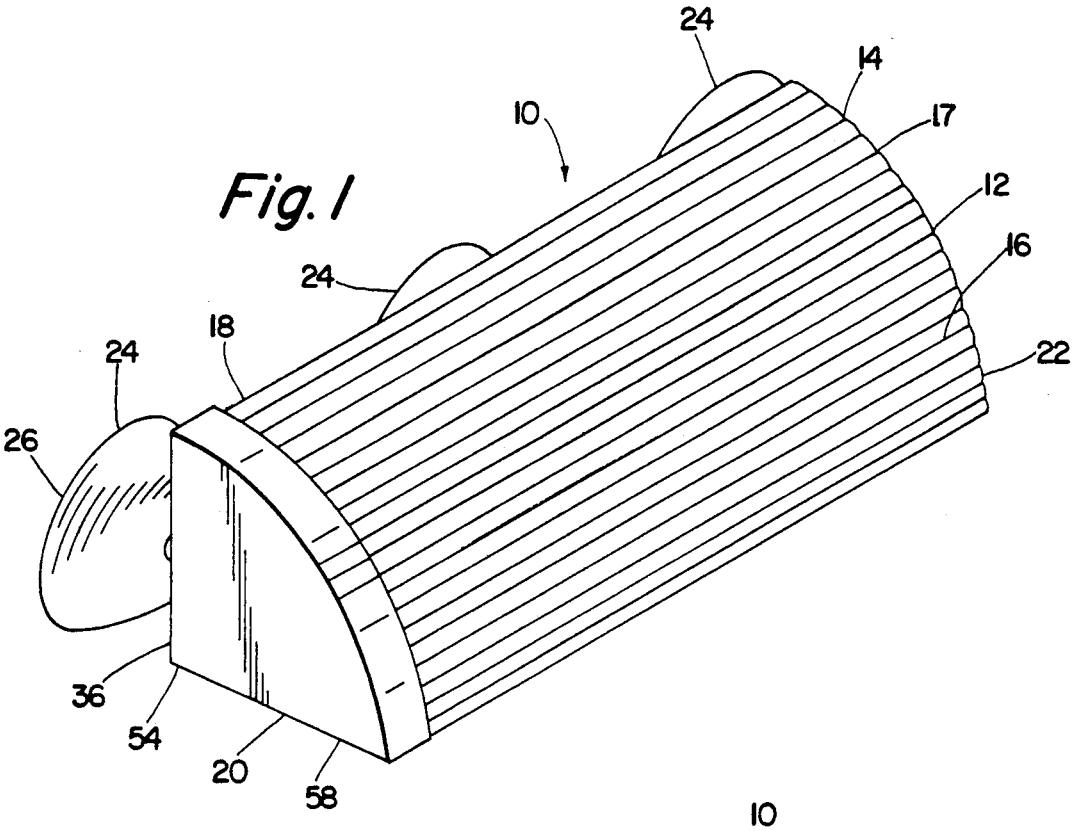
FIG. 1 is a left-front perspective of a lady's portable footrest according to the present invention.

Referring to FIG. 1, there is shown a front perspective of a lady's footrest for use in the shower or bath (footrest) 10 having an elongated hollow body 12 with an outwardly convex arcuate upper surface or top wall 14. The outwardly convex arcuate upper surface 14 has a non-skid surface 16 consisting of a plurality of parallel ridges 18 running from a left-hand end side wall 20 to a right-hand end side wall 22 of the elongated hollow body 12. In the preferred embodiment disclosed in this specification, the left-hand end wall is also a left-hand end wall of a drawer 52, but the drawer 52 may be omitted and a solid left-hand end wall 20 substituted. The body 12 further includes a bottom wall 58 for rigidity. The body 12 is preferably made of molded plastic, but can also be made from stainless steel or other suitable materials. The non-skid surface 16 can be integrally formed into the arcuate upper surface of the body 12, but is preferably a non-skid sheet or mat 17, a separate element that is fastened to the outwardly convex arcuate upper surface 14 with a suitable adhesive or other fastening system such as welding, non-rusting screws and the like. The non-skid sheet or mat 17, for example, may be a rubber mat or other material having a high-friction texture, such as hatching, knurling, parallel ridges and grooves, and the like.

Figure 2:
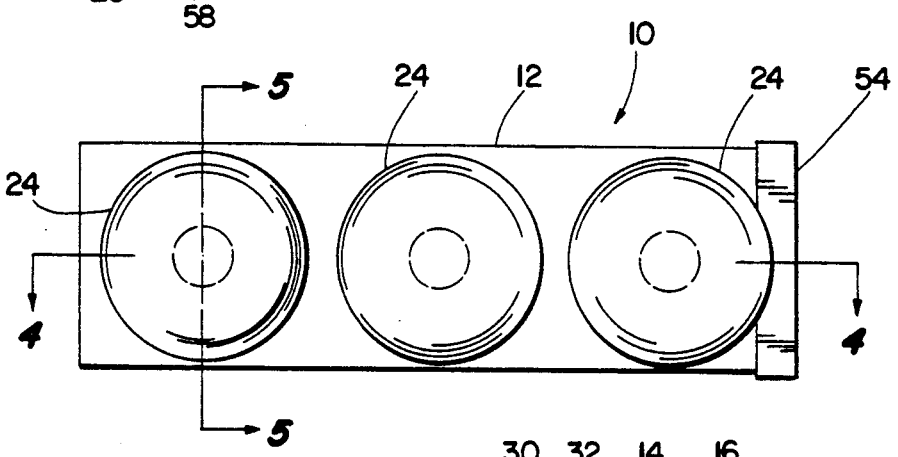
FIG. 2 is a rear elevation of the footrest of FIG. 1.

Referring to FIG. 2, three suction cups 24 secured into the elongated hollow body 12 by means described below are used to temporarily attach the footrest 10 to the shower or bath wall. The user can naturally set the footrest 10 at whatever convenient height she desires. Any desired number of suction cups 24 can, of course, be used and the size of the suction cups can be varied, depending on particular applications. When specifically intended for use in showers, for example, it is desirable that the entire outside diameter 26 of each suction cup 24 be smaller than the width of any individual shower tile so that the suction cup 24 can be seated on a shower tile (not shown). If the suction cud 24 spans more than one shower tile, the grout groove between adjacent shower tiles normally prevents the suction cup 24 from sealing, and, therefore, from holding the vacuum necessary to support the footrest 10. It has been found that recent improvements in suction cup technology, namely forming them from smoother materials, usually plastic, allow the use of ordinary suction cups and that these provide more than adequate support for ordinary use of the footrest 10. If desired in particular applications, heavy duty suction cups may be used to provide additional support.

Figure 3:
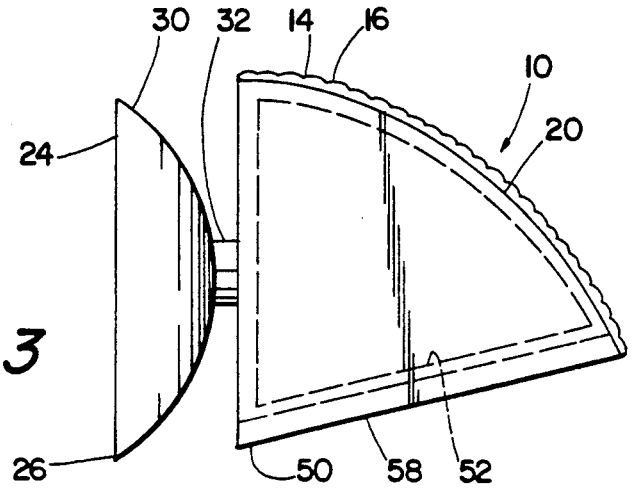
FIG. 3 is a left side elevation of the footrest of FIG. 1.

Referring to FIG. 3, the footrest 10 further includes a drawer 52 having a cross section substantially the same shape as the cross section of the footrest 10 and which runs substantially the length of the foot rest 10 (See FIG. 4). The drawer 52 is accessed by means of the enlarged drawer pull 54, which also serves as an end wall of the drawer 54 (FIGS. 1, 4), or other device. The drawer 54 also includes a far end wall opposed to the drawer pull 54 end wall, two opposed drawer side walls and a drawer bottom wall, which includes a drawer drain hole 56 to allow any water that may accumulate in the drawer 54 to drain out. The drawer drain hole 56 is located in a position that will be substantially a low or lowest point in the drawer 52 when the footrest 10 is mounted horizontally on a shower wall. A footrest drain hole 50 is similarly located in a low point of the footrest 10 when in use, allowing any water inside the footrest 10 to drain out. Naturally any desired number of drawer drain holes 56 and footrest body drain holes 50 may be included. Further, substitutes for drain holes are also available, for example, the bottom wall of the drawer 52 may be made from open mesh type material, such as expanded metal or plastic, as may the bottom wall 58 of the footrest 10.

Referring to FIG. 5, each suction cup 24 include a cup section 30 and an attached stem portion 32 that penetrates an aperture 34 in the rear side wall 36. A sheet metal screw 38 or other mechanical fastener is screwed into the center of the stem portion 32, causing the stem portion 32 to swell, thereby tightly securing the suction cup 24 into the aperture 34. Because the suction cups 24 are preferably made from a resilient pliable and soft material and the stem portion 32 and the cup portion 30 are integrally formed, a sheet metal screw or the like can easily be screwed into the stem portion 32 without first drilling any hole. Not removing material by drilling and the like from the stem portion 32 prior to inserting the screw 38 increases the swelling of the stem portion 46 and thereby actually strengthens the mechanical bond between the suction cups 30 and the elongated hollow body Access to the head of the screw 38 is gained through a screw access aperture 40 through the arcuate upper surface 14 opposite from and aligned with each stem portion 32 of each respective suction cup 24. To assemble, the stem portion 32 of each respective suction cup 24 is inserted into each aperture 34 and then a sheet metal screw 38 is screwed into the stem portions 32. In the case of a separate non-skid surface element, it is conveniently applied to the upper surface 14 after installation of the suction cups 34 to cover the screw access apertures 40.

Referring now to FIG. 6 there is shown a fragmentary side elevation of an alternative fastening system for securing the suction cups to the rear side wall 36. The alternative embodiment requires a self-seating suction cup 42 having a cup portion 44 and a connected stem portion 46 terminating at its remote end in a circular flange 48. The circular flange 48 has a relaxed or normal diameter somewhat larger than the diameter of the suction cup stem aperture 34. To install a self-seating suction cup 42, the circular flange 48 is deformed and forced through the suction cup stem aperture 34. Then the resilient circular flange 48 springs back into its equilibrium or relaxed shape, locking the self-seating suction cup 42 into position firmly. This fastening system works best when the length of the stem portion 46 is only slightly longer than the thickness of the rear side wall 36.

Referring now to FIG. 7, the lady's footrest for use in the shower or bath is shown in an environmental view. In use, a woman temporarily fixes the footrest to the shower wall or tub wall at a convenient height by sealing and seating the suction cups against the wall. She then rests her foot 62 on the footrest and applies a razor 64 to her leg 66 during leg shaving, providing greater flexibility and visibility of the area being shaved during this task. When the task is completed, the footrest is removed from the shower or tub and stored in any convenient location, such as the cabinet under the bathroom sink.

Other changes can be made to the lady's footrest for use in the shower or bath 10, which may occur to those skilled in the art. For example, the area along the rear wall adjacent to each of the suction cups can project outward a sufficient distance to contact the shower wall when the suction cups are pressed and sealed against the shower wall. Further, these raised area may be covered with a high-friction non-skid material that will help stabilize the footrest and prevent any tendency to slide downward along the shower wall as the footrest is used. In another alternative embodiment, the rear wall may, for example, be equipped with a downward diagonal brace that contacts the shower wall when the footrest is attached to the shower wall by the suction cups. The end of the brace that contacts the wall can be fitted with a non-skid crutch tip, or the like to further stabilize the footrest for use. It has been found, however that the footrest described in the preferred embodiment herein withstands considerable downward force without slipping down the shower wall.

The convenience of using the footrest can be enhanced by providing a built in strap hook at each end of the footrest, through which a removable nylon webbing strap or other strap may be inserted and fixed to simplify carrying the footrest, along with the other paraphernalia that is frequently carried to and from the shower room, particularly in institutional settings. The strap is preferably readily removable because many woman would prefer not to take the strap into the shower.

Further, for example, in some embodiments the bottom wall of the footrest made be omitted entirely provided the remaining structure is rigid enough to support the expected use load.

These and other changes may be made to the lady's foot rest for use in the shower or bath, as disclosed herein, by those skilled in the art, but these merely add to the inventors' work. Therefore, while the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

We claim:

1. A lady's footrest for use in the shower or bath comprising:

a. an elongated hollow body having a rear wall, a left-hand side wall, a right-hand side wall and an arcuate upper surface;

b. means for mounting a plurality of suction cups on said rear wall; and c. a plurality of suction cups mounted on said rear wall; and d. a drawer slidably retained within said elongated hollow body.

2. A lady's footrest for use in the shower or bath comprising:

a. an elongated hollow body having a rear wall, a left-hand side wall, a right-hand side wall and an arcuate upper surface;

b. means for mounting a plurality of suction cups on said rear wall;

c. a plurality of suction cups mounted on said rear wall;

d. a drawer slidably retained within said elongated hollow body, wherein said drawer further comprises at least one drain hole in said drawer.

3. A lady's footrest for use in the shower or bath, comprising:

a. an elongated hollow body having a rear wall, a left-hand side wall, a right-hand side wall, a bottom wall, and an arcuate upper surface comprising a top wall;

b. a plurality of apertures in said rear wall; and c. a plurality of suction cups with one said suction cup mounted in each said rear wall aperture;

d. a non-skid finish on said arcuate upper surface; and e. an elongated drawer slidably retained within said elongated hollow body.

4. A lady's footrest for use in the shower or bath, comprising:

a. an elongated hollow body having a rear wall, a left-hand side wall, a right-hand side wall, a bottom wall, and an arcuate upper surface comprising a top wall;

a plurality of suction cups with one said suction cup mounted in each said rear wall aperture;

d. a non-skid finish on said arcuate upper surface; and e. an elongated drawer slidably retained within said elongated hollow body, wherein said elongated drawer further comprises at least one drain hole in said elongated drawer.

* * * * *